US005595101A

United States Patent [19]

Yoshimatsu et al.

[11] Patent Number: 5,595,101

[45] Date of Patent: Jan. 21, 1997

[54] METHOD AND APPARATUS FOR MAKING SPLICE INDICATING HOLES THROUGH PHOTOGRAPHIC PAPER

[75] Inventors: Eiji Yoshimatsu; Shinichi Fujii; Shigeru Okitsu, all of Kanagawa-ken, Japan

[73] Assignee: Fuji Photo Film Co., Ltd., Kanagawa, Japan

[21] Appl. No.: 121,036

[22] Filed: Sep. 1, 1993

Related U.S. Application Data

[63] Continuation of Ser. No. 804,734, Dec. 11, 1991, abandoned.

[30] Foreign Application Priority Data

Dec. 12, 1990 [JP] Japan ..... 2-401488

[51] Int. Cl.[6] ..... B26D 7/01; B26D 9/00; B26F 1/02

[52] U.S. Cl. ..... 83/40; 83/34; 83/44; 83/50; 83/76.8; 83/405; 83/451; 83/560; 83/564; 83/614; 156/252

[58] Field of Search ..... 83/34, 40, 44, 83/50, 55, 56, 72, 76.8, 213, 214, 282, 560, 614, 682, 564, 405, 407, 948; 156/502, 504, 157, 252, 253, 64

[56] References Cited

U.S. PATENT DOCUMENTS

| | | | |
|---|---|---|---|
| 2,989,883 | 6/1961 | Zimski et al. | 83/34 |
| 3,670,612 | 6/1972 | Johnson et al. | 83/451 |
| 4,192,209 | 3/1980 | Urbanski | 83/564 |
| 4,243,314 | 1/1981 | Bowe et al. | 83/560 |
| 4,285,754 | 8/1981 | DiMatteo | 83/55 |

FOREIGN PATENT DOCUMENTS

| | | | |
|---|---|---|---|
| 0229842 | 7/1987 | European Pat. Off. . | |
| 2540422 | 8/1984 | France | 83/405 |
| 2355313 | 5/1974 | Germany | 83/405 |
| 64-41981 | 2/1989 | Japan . | |
| 604298 | 7/1948 | United Kingdom | 83/451 |
| 1396239 | 6/1975 | United Kingdom | 83/451 |

*Primary Examiner*—Eugenia Jones
*Assistant Examiner*—Charles Goodman
*Attorney, Agent, or Firm*—Sughrue, Mion, Zinn, Macpeak & Seas

[57] ABSTRACT

In a method for making splice indicating holes through photographic paper, a long strip of photographic paper web is conveyed in its longitudinal direction and is slit into a plurality of narrow webs, a tail end of the photographic paper web is spliced to a leading end of a new photographic paper web, and a plurality of splice indicating holes are made through the new photographic paper web at positions, which are spaced a predetermined distance from the splice of the new photographic paper web, the predetermined distance being taken in the longitudinal direction of the new photographic paper web, and which coincide with center parts of narrow webs into which the new photographic paper web will later be slit. The method for making splice indicating holes through photographic paper comprises the steps of, before the new photographic paper web is spliced to the previous photographic paper web, making the splice indicating holes through the new photographic paper web, and cutting the new photographic paper web in its width direction and at a position spaced a predetermined distance from the positions, at which the splice indicating holes are made, towards the leading end of the new photographic paper web.

8 Claims, 6 Drawing Sheets

METHOD AND APPARATUS FOR MAKING SPLICE INDICATING HOLES THROUGH PHOTOGRAPHIC PAPER

This is a Continuation of application Ser. No. 07/804,734, filed Dec. 11, 1991, now abandoned.

BACKGROUND OF THE INVENTION

1. Field of the Invention

This invention relates to a method for making splice indicating holes through roll of photographic paper, which are to be loaded into an automatic printer. This invention particularly relates to a method for making splice indicating holes through a wide photographic paper web before the photographic paper web is slit into a plurality of narrow webs of photographic paper. This invention also relates to an apparatus for carrying out the method.

2. Description of the Prior Art

In general, rolls of photographic paper, which are to be loaded into an automatic printer, are prepared by slitting a wide photographic paper web into a plurality of narrow webs and winding up predetermined lengths of the slit webs around cores. For this purpose, by way of example, a slitting machine disclosed in, for example, U.S. Pat. No. 4,629,139 may be used. In cases where the length of a photographic paper web becomes shorter than the predetermined length, a leading end of a new photographic paper web is spliced to the tail end of the photographic paper web which is shorter than the predetermined length. For this purpose, by way of example, a splicing apparatus disclosed in, for example, Japanese Patent Publication No. 1(1989)-41981 may be used. In such cases, the rolls of photographic paper, which have been obtained by slitting the spliced photographic paper web, have splices at which the two photographic paper webs were spliced. In the automatic printer, the splices are removed automatically such that they may not be used.

Therefore, it has been stipulated in an international standard (ISO TC42/WG8) that rolls of photographic paper must be provided with splice indicating holes from which the presence of splices is to be detected automatically. The splice indicating hole is located on the center line of the roll of photographic paper and at a position spaced a predetermined distance from the splice of photographic paper.

Heretofore, in order for splice indicating holes to be made, a number of sets of punches and dies, which number is equal to the number of narrow webs into which a photographic paper web is slit, are located side by side in the width direction of the photographic paper web and in the vicinity of the photographic paper web, which is conveyed from a web splicing apparatus to a slitting apparatus. When a splice between two photographic paper webs reaches a predetermined position, the conveyance of the web is ceased, and the punches and the dies are operated together.

FIG. 10 is a perspective view showing an example of a conventional perforating apparatus for making splice indicating holes through a photographic paper web. FIG. 11 is a perspective view showing part of the conventional perforating apparatus of FIG. 10. With reference to FIGS. 10 and 11, a perforating apparatus 50 comprises a number of sets of punches 54, 54, . . . and dies 55, 55, . . . , which number is equal to the number of narrow webs into which a photographic paper web 53 is slit. The multiple sets of the punches 54, 54, . . . and the dies 55, 55, . . . are located side by side in the width direction of the photographic paper web 53 and in the vicinity of the photographic paper web 53, which is conveyed from a web splicing apparatus 51 to a slitting apparatus 52. The photographic paper web 53 is conveyed through the space between the punches 54, 54, . . . and the dies 55, 55, . . . The punches 54, 54, . . . are moved together up and down in FIG. 11 by cams 58, 58, . . . which are secured to a shaft 57. The shaft 57 is rotated by a motor 56. The punches 54, 54, . . . fit into die cavities 55*a*, 55*a*, . . . of the dies 55, 55, . . . with the photographic paper web 53 intervening therebetween. In this manner, a plurality of splice indicating holes 59, 59, . . . are simultaneously made through the photographic paper web 53. In FIG. 10, reference numeral 60 represents a web splice. The photographic paper web 53 is slit later along broken lines 61, 61, . . . .

In cases where the multiple sets of punches and dies described above are used, when the width, into which the photographic paper web is to be slit, is changed, the intervals between the respective sets of the punches and the dies in the width direction of the photographic paper web are adjusted again in accordance with the new value of the width, into which the photographic paper web is to be slit. Alternatively, the previous unit of the multiple sets of the punches and the dies is replaced by a new unit of multiple sets of punches and dies, in which new unit the intervals between the respective sets of the punches and the dies in the width direction of the photographic paper web correspond to the new value of the width, into which the photographic paper web is to be slit.

However, with the conventional perforating method wherein the punches and dies described above are used, it is necessary for the conveyance of the photographic paper web to be ceased temporarily when splice indicating holes are made through the photographic paper web. Therefore, loss of time occurs during the operation, and the efficiency with which the slitting operation is carried out cannot be kept high.

Also, in cases where the intervals between the respective sets of the punches and the dies are adjusted again or the unit of the multiple sets of the punches and the dies is replaced by a new unit of multiple sets of punches and dies each time the width, into which the photographic paper web is to be slit, is changed, the slitting operation must be ceased. Therefore, the productivity cannot be kept high.

Additionally, in cases where the unit of the multiple sets of the punches and the dies is replaced by a new unit of multiple sets of punches and dies, it is necessary for several units to be prepared. Therefore, the cost of the perforating apparatus cannot be kept low. The cost of the perforating apparatus becomes higher when the width, into which the photographic paper web is to be slit, is changed to a wider variety of values.

SUMMARY OF THE INVENTION

The primary object of the present invention is to provide a method for making splice indicating holes through photographic paper, in which an operation for slitting a photographic paper web need not be ceased temporarily but with which splice indicating holes can be made at positions spaced a predetermined distance from a splice of the photographic paper web, the predetermined distance being taken in the longitudinal direction of the photographic paper web.

Another object of the present invention is to provide an apparatus for making splice indicating holes through photographic paper, which is suitable for carrying out the method for making splice indicating holes through photographic paper.

The specific object of the present invention is to provide an apparatus for making splice indicating holes through photographic paper, in which adjustment of positions of punches and dies and replacement of a unit of punches and dies with a new one need not be carried out but which can cope with any change in the width, into which a photographic paper web is to be slit.

The present invention provides a method for making splice indicating holes through photographic paper, wherein a long strip of photographic paper web is conveyed in its longitudinal direction and is slit into a plurality of narrow webs, a tail end of the photographic paper web is spliced to a leading end of a new photographic paper web, and a plurality of splice indicating holes are made through the new photographic paper web at positions, which are spaced a predetermined distance from the splice of the new photographic paper web, the predetermined distance being taken in the longitudinal direction of the new photographic paper web, and which coincide with center parts of narrow webs into which the new photographic paper web will later be slit, the method for making splice indicating holes through photographic paper comprising the steps of:

i) before said new photographic paper web is spliced to the previous photographic paper web, making said splice indicating holes through said new photographic paper web, and ii) cutting said new photographic paper web in its width direction and at a position spaced a predetermined distance from the positions, at which said splice indicating holes are made, towards the leading end of said new photographic paper web.

The present invention also provides an apparatus for making splice indicating holes through photographic paper, which comprises:

i) a holding means for holding an end part of a long strip of photographic paper web, ii) a movable member which is capable of moving along said end part of said photographic paper web and in the width direction of said photographic paper web, iii) a perforating means which is supported on said movable member and which makes splice indicating holes through said photographic paper web, iv) a control means which controls said movable member such that said movable member may be stopped at predetermined positions with respect to the width direction of said photographic paper web, and which activates said perforating means when said movable member stops, and v) a cutting means for cutting said photographic paper web in its width direction and at a position spaced a predetermined distance from the positions, at which said splice indicating holes are made by said perforating means, towards the leading end of said photographic paper web.

With the method for making splice indicating holes through photographic paper in accordance with the present invention, before a new photographic paper web is spliced to a previous photographic paper web, splice indicating holes are made through the new photographic paper web. In such cases, the operation for making the splice indicating holes through the photographic paper web need not be carried out while the photographic paper web is being slit into a plurality of narrow webs. Specifically, the operation for slitting the photographic paper web need not be ceased temporarily. Therefore, the efficiency, with which the operation for slitting the photographic paper web is carried out, can be kept high.

As described above, with the method for making splice indicating holes through photographic paper in accordance with the present invention, before a new photographic paper web is spliced to a previous photographic paper web, the splice indicating holes are made through the new photographic paper web. Also, the new photographic paper web is cut in its width direction and at a position spaced a predetermined distance from the positions, at which the splice indicating holes are made, towards the leading end of the new photographic paper web. Therefore, at the time at which the leading end of the new photographic paper web is later spliced to the tail end of the previous photographic paper web, the positions of the splice indicating holes may coincide with the positions, which are stipulated by the international standard and which are spaced a predetermined distance from the splice of the new photographic paper web.

With the apparatus for making splice indicating holes through photographic paper in accordance with the present invention, a single perforating means is moved by the movable member in the width direction of the photographic paper web and makes a plurality of the splice indicating holes through the photographic paper web one after another. The control means controls the positions, at which the movable member is stopped. Therefore, the splice indicating holes can be made through the photographic paper web at arbitrary intervals with respect to the width direction of the photographic paper web.

Accordingly, with the apparatus for making splice indicating holes through photographic paper in accordance with the present invention, even if the width, into which the photographic paper web is to be slit, is changed to various values, the splice indicating holes can be made at intervals corresponding to any of various values of the slitting width. Such effects can be obtained with a single apparatus for making splice indicating holes through photographic paper in accordance with the present invention. Therefore, the cost of the apparatus for making splice indicating holes through photographic paper in accordance with the present invention can be kept lower than the cost of an apparatus for making splice indicating holes through photographic paper wherein many units of punches and dies are prepared in accordance with various values of the width, into which the photographic paper web is to be slit. Also, the apparatus for making splice indicating holes through photographic paper in accordance with the present invention can cope with any change in the width, into which the photographic paper web is to be slit, by changing the positions at which the movable member stops. Therefore, with the apparatus for making splice indicating holes through photographic paper in accordance with the present invention, adjustment of positions of punches and dies and replacement of a unit of punches and dies with a new one need not be carried out. Accordingly, the productivity can be kept high.

The method for making splice indicating holes through photographic paper in accordance with the present invention can also be carried out with an apparatus for making splice indicating holes through photographic paper, which comprises:

i) a holding means for holding an end part of a long strip of photographic paper web, ii) a plurality of dies which are located in said holding means, iii) a swingable member which is capable of swinging between a position facing said end part of said photographic paper web and a position retracted from said end part of said photographic paper web, iv) a plurality of punches which are supported on said swingable member and which make splice indicating holes through said photographic paper web by cooperating with said dies when said swingable member has been swung to said position facing said end part of said photographic paper web, v) a control means which controls said swingable member and which activates said punches when said swingable member has been swung to said position facing said end part of said photographic paper web, and vi) a cutting means for cutting said photographic paper web in its width direction and at a position spaced a predetermined distance from the positions, at which said splice indicating holes are made by said punches and said dies, towards the leading end of said photographic paper web.

DESCRIPTION OF THE PREFERRED EMBODIMENTS

The present invention will hereinbelow be described in further detail with reference to the accompanying drawings.

Figure 1:
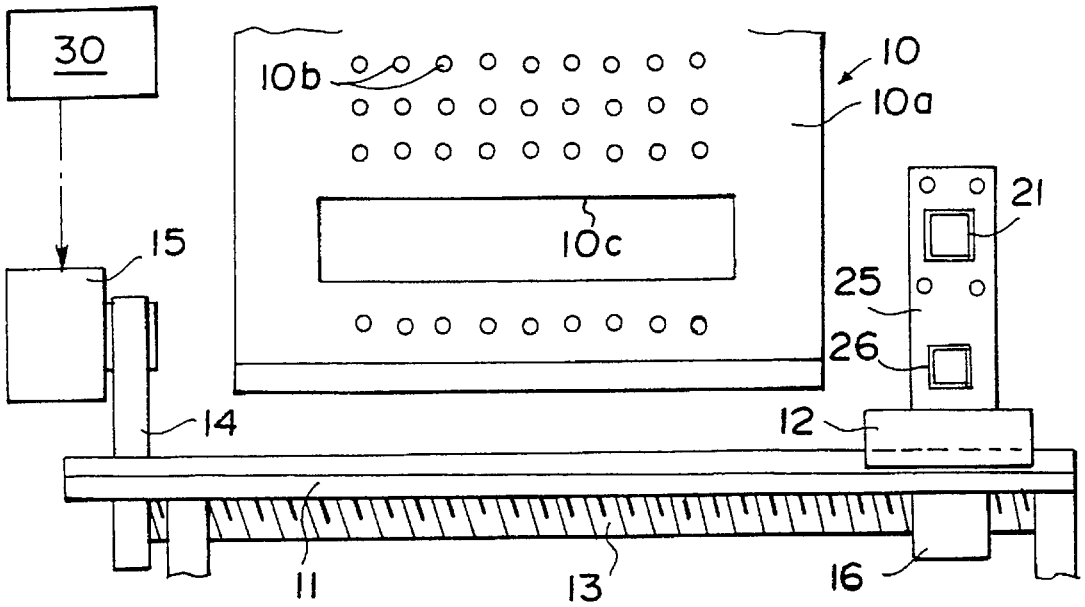
FIG. 1 is a front view showing an embodiment of the apparatus for making splice indicating holes through photographic paper in accordance with the present invention, which is in a state before the operation for making splice indicating holes is begun.
Figure 2:
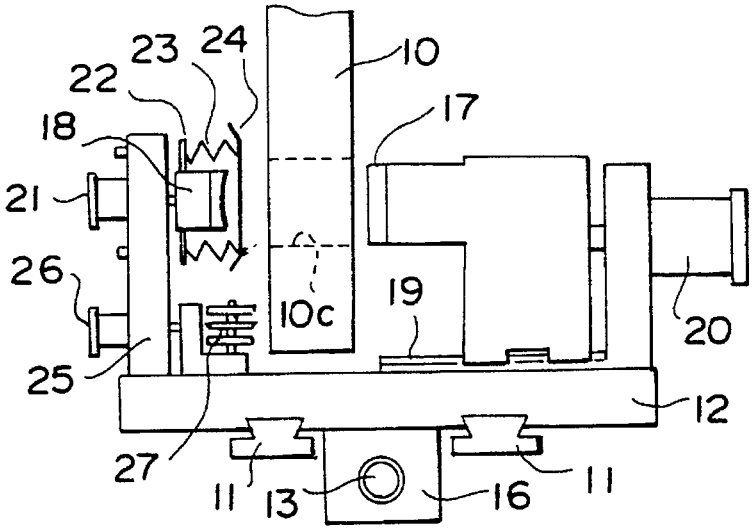
FIG. 2 is a side view showing the embodiment of FIG. 1, which is in the state before the operation for making splice indicating holes is begun.
Figure 3:
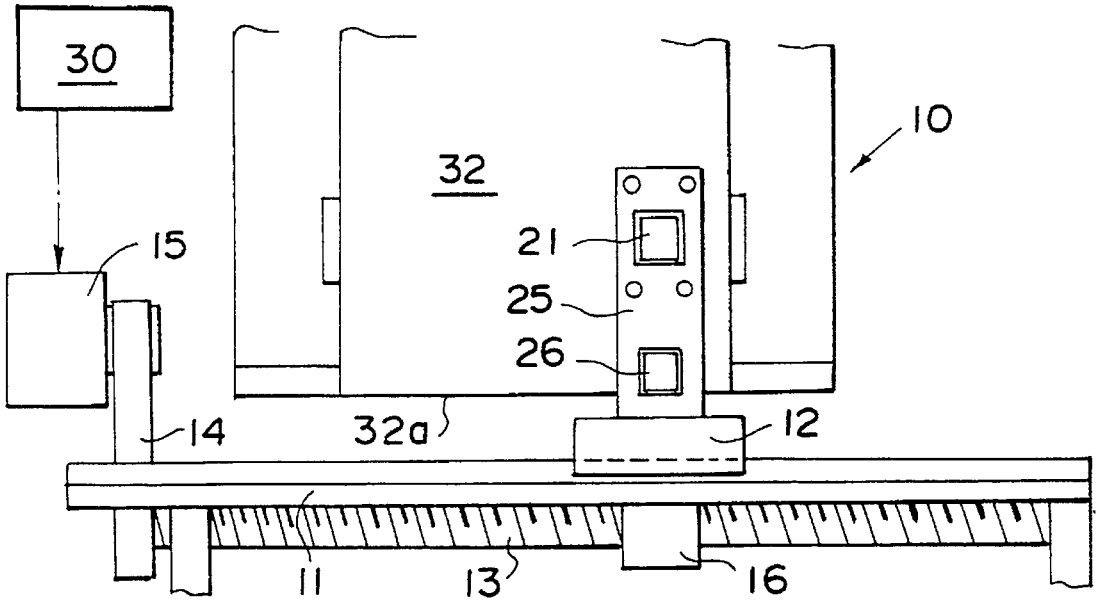
FIG. 3 is a front view showing the embodiment of FIG. 1, which is in the state during the operation for making splice indicating holes.
Figure 4:
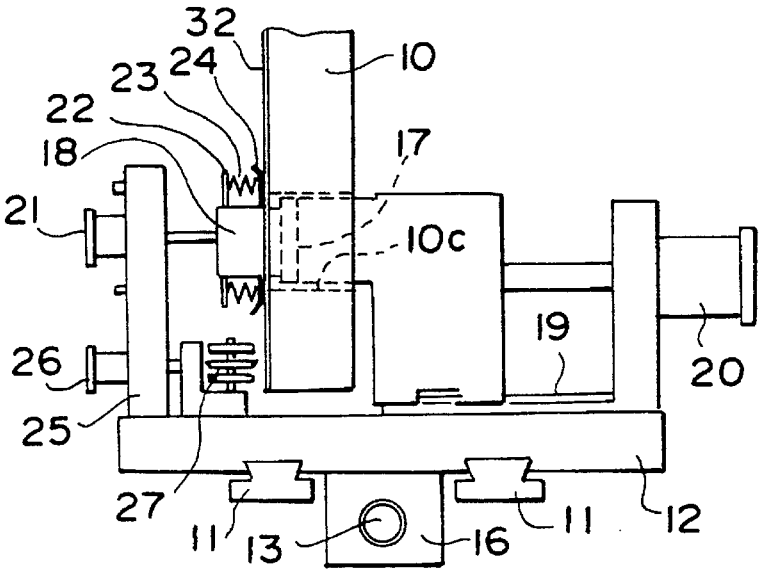
FIG. 4 is a side view showing the embodiment of FIG. 1, which is in the state during the operation for making splice indicating holes.
Figure 5:
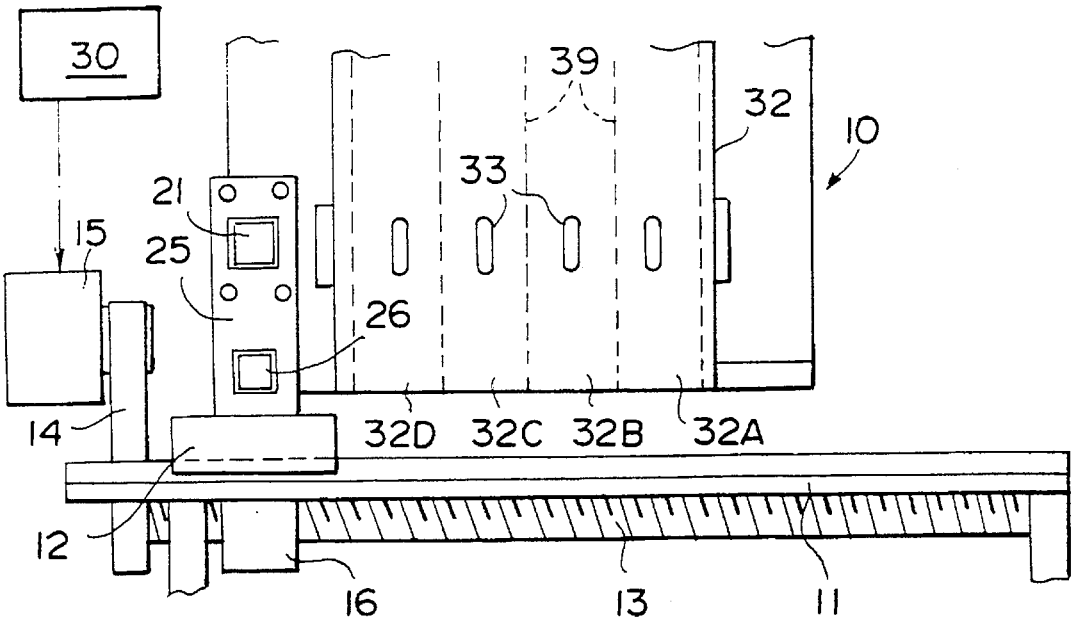
FIG. 5 is a front view showing the embodiment of FIG. 1, which is in the state in which the operation for cutting a photographic paper web is begun.
Figure 6:
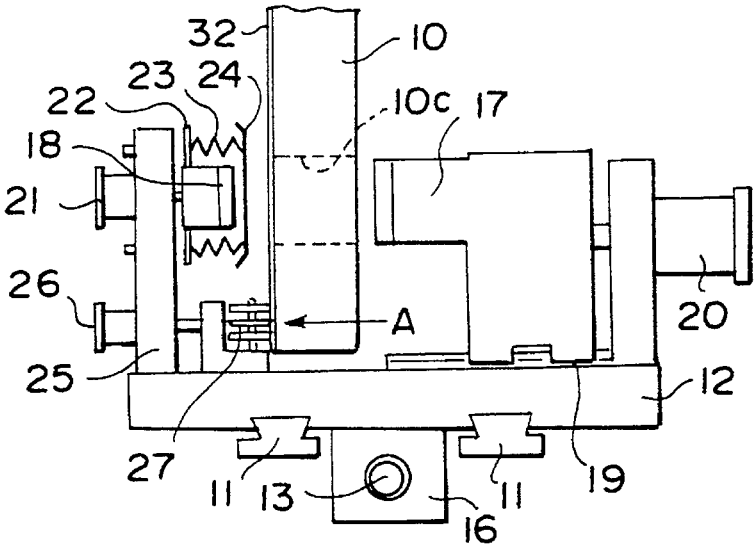
FIG. 6 is a side view showing the embodiment of FIG. 1, which is in the state in which the operation for cutting the photographic paper web is begun.

FIGS. 1 through 6 show an embodiment of the apparatus for making splice indicating holes through photographic paper in accordance with the present invention. FIGS. 1, 3, and 5 are front views showing the embodiment and serve as an aid in explaining how the operations are carried out sequentially in the embodiment. FIGS. 2, 4, and 6 are side views corresponding to the states shown in FIGS. 1, 3, and 5.

As illustrated in FIGS. 1 and 2, this embodiment is provided with a suction box 10 which constitutes an example of the holding means for holding an end part of a photographic paper web, which will be described later. A surface 10*a* of the suction box 10 is provided with a plurality of air suction holes 10*b*, 10*b*, . . . . and a large opening 10*c* through which a perforating means described later passes. The space in the inside of the suction box 10 is connected by a pipe to a vacuum pump (not shown), or the like, and is evacuated. In this manner, air suction is effected through the air suction holes 10*b*, 10*b*, . . .

A pair of guide rails 11, 11 are located below the suction box 10. The guide rails 11, 11 extend in the width direction of the suction box 10. A movable member 12 is engaged with the guide rails 11, 11 such that it can move along the guide rails 11, 11. Also, a ball screw 13 is supported below the guide rails 11, 11 such that it can rotate. The ball screw 13 extends in parallel with the guide rails 11, 11. The ball screw 13 is rotated in normal and reverse directions by a servo motor 15 via a power transmitting means 14, which may be constituted of a belt, a chain, a gear, or the like.

The ball screw 13 is engaged with a female thread block 16, which is secured to the movable member 12. Therefore, when the ball screw 13 rotates in the normal and reverse directions, the movable member 12 is thereby moved leftwardly or rightwardly in FIG. 1.

The perforating means is supported on the movable member 12. The perforating means comprises a die 17, a drive means for the die 17, a punch 18, and a drive means for the punch 18. The die 17 is located at the height corresponding to the position of the opening 10*c* of the suction box 10. A base part of the die 17 is engaged with a rail 19, which is secured to the movable member 12, such that the die 17 can move leftwardly and rightwardly in FIG. 2 along the rail 19. The die 17 is thus moved by an air cylinder 20.

The punch 18 is located facing the die 17. The punch 18 is moved leftwardly and rightwardly in FIG. 2 by an air cylinder 21. The air cylinder 21 is supported on a support member 25, which is secured to the movable member 12. A support member 22 is secured to a base edge part of the punch 18. Edges of a plurality of springs 23, 23, . . . are secured to the support member 22. A paper pushing member 24 is secured to the other edges of the springs 23, 23, . . . The paper pushing member 24 is provided with a through hole (not shown), through which the punch 18 can pass. An air cylinder 26 is also supported on the support member 25. The air cylinder 26 moves a cutter 27 leftwardly and rightwardly in FIG. 2.

A controller 30 controls three-way solenoid valves, or the like, which feed compressed air into the three air cylinders 20, 21, and 26 and discharge the compressed air therefrom. In this manner, the controller 30 controls the three air cylinders 20, 21, and 26. The controller 30 also controls the servo motor 15.

How this embodiment operates will be described hereinbelow.

The movable member 12 is located at the initial position shown in FIG. 1. In this state, as shown in FIG. 3, a photographic paper web 32 is placed on the surface 10*a* of the suction box 10. The photographic paper web 32 is the one which is to be spliced later to a previous photographic paper web. The photographic paper web 32 is conveyed by a known conveyance means (not shown) downwardly from above along the surface 10*a* of the suction box 10. The photographic paper web 32 is stopped at the time at which its leading end 32*a* has been brought to a position approximately aligning the lower edge of the suction box 10. Thereafter, air suction is effected through the air suction holes 10*b*, 10*b*, . . . , and the photographic paper web 32 is thereby held on the suction box 10.

Thereafter, the servo motor 15 is activated in order to move the movable member 12 leftwardly in FIG. 1. The movable member 12 is stopped at the position shown in FIG. 3. The air cylinders 20 and 21 are then activated in order to move the die 17 and the punch 18 as shown in FIG. 4. Specifically, the die 17 is moved through the opening 10*c* of the suction box 10 to a position that is close to or in contact with the photographic paper web 32. Also, the punch 18 fits into a die cavity (not shown) of the die 17. In this manner, as shown in FIG. 5, a first splice indicating hole 33 is made through the photographic paper web 32, which intervenes between the die 17 and the punch 18. At this time, the paper pushing member 24 is in resilient contact with the photographic paper web 32 and thereby fixes it.

Thereafter, the air cylinders 20 and 21 are operated reversely to the aforesaid operations, and the die 17 and the punch 18 are thereby returned to their original positions. The servo motor 15 is then operated to move the movable member 12 a predetermined distance from the position shown in FIG. 3 to a more leftward position. At this position, a second splice indicating hole 33 is made through the photographic paper web 32 in the same manner as that described above. The operations described above are repeated, and a plurality of splice indicating holes 33, 33, . . . are thereby made through the photographic paper web 32. The plurality of the splice indicating holes 33, 33, . . . are made at predetermined intervals with respect to the width direction of the photographic paper web 32.

Figure 10:
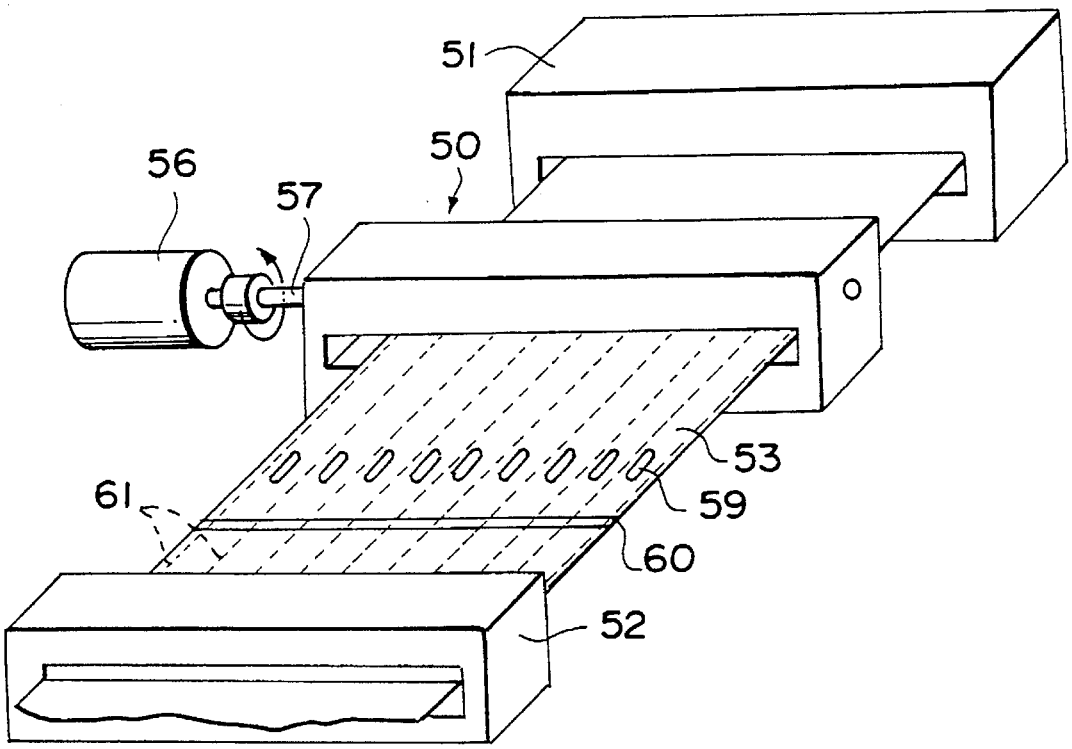
FIG. 10 PRIOR ART
FIG. 10 is a perspective view showing an example of a conventional perforating apparatus for making splice indicating holes through photographic paper.
Figure 11:
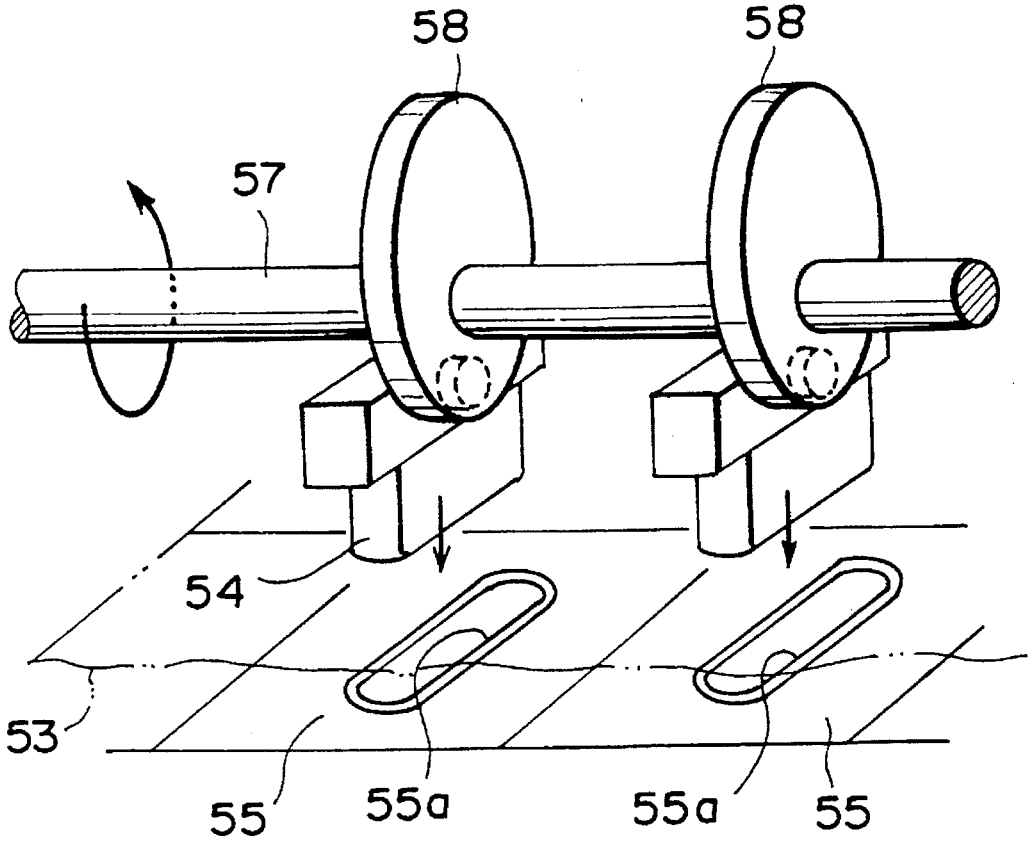
FIG. 11 PRIOR ART
FIG. 11 is a perspective view showing part of the conventional perforating apparatus of FIG. 10.

The photographic paper web 32, through which the plurality of the splice indicating holes 33, 33, . . . have been made in the manner described above, is later fed into a splicing apparatus, which may be of the same type as the splicing apparatus 51 shown in FIG. 10. In the splicing apparatus, the photographic paper web 32 is spliced with a previous photographic paper web and is thereafter slit into a plurality of narrow webs. In FIG. 5, broken lines 39, 39, . . . indicate the lines along which the photographic paper web 32 is later slit into narrow webs 32A, 32B, 32C, and 32D. As illustrated in FIG. 5, it is necessary for the splice indicating holes 33, 33, . . . to be made on the center lines of the slit webs 32A, 32B, 32C, and 32D. The splice indicating holes 33, 33, . . . may be made at such positions, the controller 30 controls the positions, at which the movable member 12 stops, in accordance with the width, into which the photographic paper web 32 is to be slit thereby designating the strips into which the web is to be slit.

Even if the width, into which the photographic paper web 32 is to be slit, is changed to any of various values, the splice indicating holes 33, 33, . . . can be made at appropriate positions by changing the positions, at which the movable member 12 stops, with the controller 30 in accordance with the new value of the slitting width. Also, for this purpose, only the setting with the controller 30 may be changed. Adjustment, replacement, or the like, of the parts of the apparatus need not be carried out. Therefore, the productivity is not adversely affected by a change in the width, into which the photographic paper web 32 is to be slit.

After the plurality of splice indicating holes 33, 33, . . . have been made through the photographic paper web 32 in the manner described above, the movable member 12 is located at the position shown in FIG. 5. Also, as shown in FIG. 6, the air cylinder 26 is activated in order to move the cutter 27 to the position that is in contact with the photographic paper web 32. Thereafter, the servo motor 15 is operated, and the movable member 12 is moved rightwardly in FIG. 5 and is thus returned to the initial position shown in FIG. 1. During this movement of the movable member 12, the cutter 27 is kept in contact with the photographic paper web 32, and therefore the photographic paper web 32 is cut in its width direction at a position in the vicinity of its leading end (i.e. at the position indicated by the arrow A in FIG. 6).

In cases where the photographic paper web 32 is cut in the manner described above and its new leading end of is thereby formed, the plurality of the splice indicating holes 33, 33, . . . become located at positions spaced a predetermined distance from the new leading end of the photographic paper web 32, the predetermined distance being taken in the longitudinal direction of the photographic paper web 32. Therefore, when the photographic paper web 32 is later spliced to the previous photographic paper web, the splice indicating holes 33, 33, . . . become spaced a predetermined distance from the splice of the photographic paper web 32 in the longitudinal direction of the photographic paper web 32. Accordingly, the splice indicating holes 33, 33, . . . satisfy the stipulation in the international standard.

Figure 7:
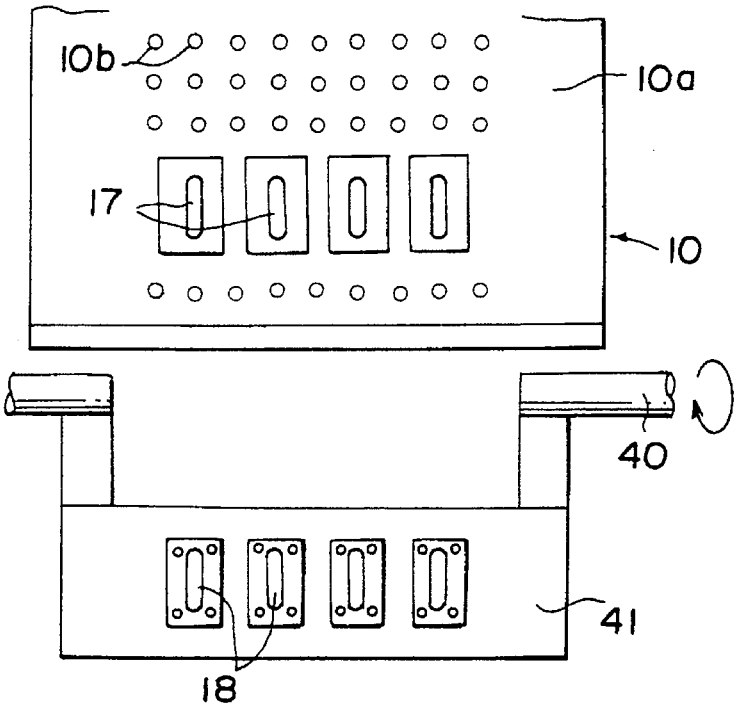
FIG. 7 is a front view showing an embodiment of a different apparatus for carrying out the method for making splice indicating holes through photographic paper in accordance with the present invention.
Figure 8:
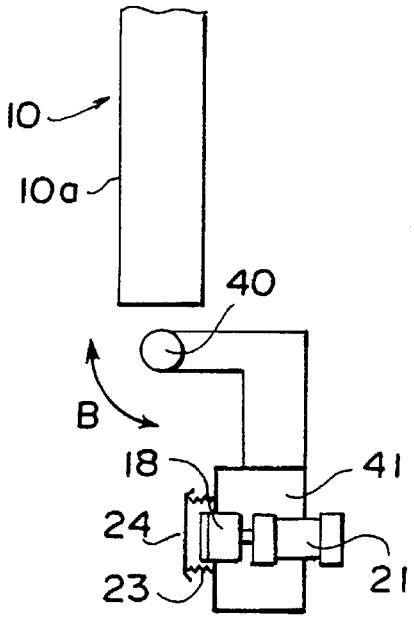
FIG. 8 is a side view showing the embodiment of FIG. 7, which is in the state before the operation for making splice indicating holes is begun.
Figure 9:
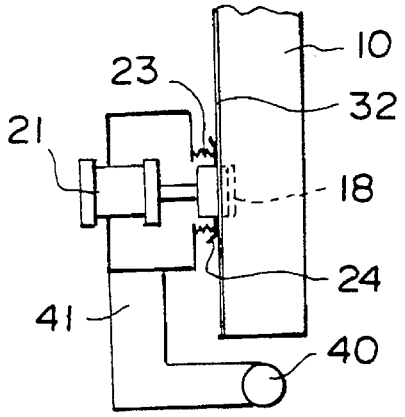
FIG. 9 is a side view showing the embodiment of FIG. 7, which is in the state during the operation for making splice indicating holes.

The method for making splice indicating holes through photographic paper in accordance with the present invention is not limited to processes, wherein the width, into which the photographic paper web is to be slit, is changed, but is also applicable when the width, into which the photographic paper web is to be slit, is constant. FIGS. 7, 8 and 9 show an embodiment of a different apparatus, which carries out the method for making splice indicating holes through photographic paper in accordance with the present invention, wherein the width, into which the photographic paper web is to be slit, is constant. This embodiment will be described hereinbelow. In FIGS. 7, 8, and 9, similar elements are numbered with the same reference numerals with respect to FIGS. 1 through 6.

In this embodiment, a plurality of (in this example, four) dies 17, 17, . . . are embedded in the suction box 10. A swingable punch box 41 is located below the suction box 10. As illustrated in FIG. 8, the swingable punch box 41 is swung by a drive means (not shown) in the directions indicated by the double headed arrows B around a shaft 40. A number of punches 18, 18, . . . , which number is equal to the number of the dies 17, 17, . . . , are secured to the swingable punch box 41.

Before the operation for making the splice indicating holes is begun, the swingable punch box 41 is located at the position shown in FIGS. 7 and 8. In this state, the photographic paper web 32 is held by the suction box 10 in the same manner as that described above. Thereafter, as shown in FIG. 9, the swingable punch box 41 is swung upwardly. In this manner, a plurality of the splice indicating holes are simultaneously made through the photographic paper web 32. With this embodiment, the plurality of the splice indicating holes can be made more quickly than the embodiment of FIGS. 1 through 6.

After the plurality of the splice indicating holes have been made through the photographic paper web 32 in the manner described above, the swingable punch box 41 is returned to the position shown in FIG. 8. The leading end part (in FIG. 8, the lower end part) of the photographic paper web 32 is cut at a position spaced a predetermined distance from the splice indicating holes. For this purpose, a known cutting means may be employed. Alternatively, the cutting of the photographic paper web 32 may be carried out with a movable cutting blade, which has a length equal to or longer than the width of the photographic paper web 32 and which is secured to the swingable punch box 41, and a stationary cutting blade, which is secured to the side of the suction box 10.

What is claimed is:

1. A method for making a plurality of splice indicating holes through a photographic paper web, comprising the steps of:

i) providing a control means, a movable member, and a punching means supported on said movable member;

ii) using said control means to designate a plurality of strips of respective determined widths as areas into which the photographic paper web is to be slit, each designated strip having a longitudinal axis extending parallel to the longitudinal axis of the web;

iii) using said control means to control said movable member to stop at predetermined intervals with respect to a width direction of said photographic paper web and to activate said punching means to form said plurality of splice indicating holes through said photographic paper web one after another at the predetermined intervals with respect to the width direction of said photographic paper web, said predetermined intervals being adjusted in accordance with the width of the strips into which said photographic paper web is to be slit, thereby disposing at least one of said splice indicating holes in each of said strips into which said photographic paper web is to be slit;

iv) cutting said photographic paper web in the width direction a predetermined distance from said splice indicating holes, said cutting step forming an end of the photographic paper web, wherein all of said plurality of splice indicating holes made through the photographic paper web are thereby equally spaced a predetermined longitudinal distance from the end of the photographic paper web.

2. A method for making splice indicating holes according to claim 1, wherein each of said splice indicating holes coincides with a center of each of said areas into which said photographic paper web is to be slit.

3. An apparatus for making splice indicating holes through a photographic paper web which is adapted to be slit into a plurality of narrow strips of respective predetermined widths, comprising:

i) a holding means for holding a leading end part of said photographic paper web;

ii) a movable member which moves along said leading end part of said photographic paper web and in the width direction of said photographic paper web;

iii) punching means which is supported on said movable member for punching a plurality of splice indicating holes through said photographic paper web across said web in the width direction;

iv) a control means which designates the plurality of narrow strips into which the web is to be slit and controls said moveable member such that said movable member successively stops at predetermined positions respectively separated by a distance substantially equal to said predetermined widths, and which activates said punching means when said movable member stops to successively punch said splice indicating holes in said plurality of narrow strips into which the web is to be slit; and v) a cutting means for cutting said photographic paper web in the width direction and at a position spaced a predetermined distance from said splice indicating holes made by said punching means, said cutting means forming an end of said photographic paper web so that all of said splice indicating holes are the same predetermined distance from the end of said photographic paper web.

4. An apparatus as defined in claim 3 wherein said punching means comprises a single die and a single punch.

5. An apparatus as defined in claim 3 wherein said cutting means is supported on said movable member, and said cutting means cuts said photographic paper web by pressing said web against a bottom portion of said holding means, thereby using said holding means as a cutting board.

6. An apparatus for making splice indicating holes through a photographic paper web, comprising:

i) control means for designating a plurality of strip-like areas of the photographic paper web as areas into which the photographic web is to be slit;

ii) a holding means for holding a leading end part of said photographic paper web by air suction;

iii) a movable member which moves along said leading end part of said photographic paper web and in the width direction of said photographic paper web;

iv) a perforating means which is supported on said movable member and which makes a plurality of splice indicating holes through said photographic paper web across said web in the width direction, wherein said perforating means passes through an opening in said holding means;

v) said control means also controls said moveable member such that said movable member stops at predetermined positions with respect to the width direction of said photographic paper web, and which activates said perforating means when said movable member stops; and vi) a cutting means for cutting said photographic paper web in the width direction and at a position spaced a predetermined distance from said splice indicating holes made by said perforating means, said cutting means forming an end of said photographic paper web so that all of said splice indicating holes are the same predetermined distance from the end of said photographic paper web.

7. An apparatus for making splice indicating holes through photographic paper, which comprises:

i) a holding means for holding an end part of a long strip of photographic paper web, ii) plurality of dies which are located in said holding means, iii) a swingable member which is capable of swinging between a position facing said end part of said photographic paper web and a position retracted from said end part of said photographic paper web, iv) a plurality of punches which are supported on said swingable member and which make splice indicating holes through said photographic paper web by cooperating with said dies when said swingable member is swung to said position facing said end part of said photographic paper web, said punches and said dies cooperating as a result of said swingable member being swung upwards, v) a control means which controls said swingable member and which activates said punches when said swingable member has been swung to said position facing said end part of said photographic paper web, and vi) a cutting means for cutting said photographic paper web in a width direction and at a position spaced a predetermined distance from the positions, at which said splice indicating holes are made by said punches and said dies, towards a leading end of said photographic paper web.

8. An apparatus as defined in claim 7 wherein said holding means holds said end part of said long strip of photographic paper web by air suction.

* * * * *